United States Patent [19]

Good

[11] Patent Number: 4,485,063

[45] Date of Patent: Nov. 27, 1984

[54] PROCESS FOR DRAWING POLYAMIDE YARN

[75] Inventor: Alfred N. Good, Hixson, Tenn.

[73] Assignee: E. I. Du Pont de Nemours & Company, Wilmington, Del.

[21] Appl. No.: 532,447

[22] Filed: Sep. 15, 1983

[51] Int. Cl.[3] ..... B29C 17/02

[52] U.S. Cl. ..... 264/235.6; 28/246; 264/290.5; 264/290.7

[58] Field of Search ..... 264/235.6, 210.7, 210.8, 264/288.8, 290.5, 290.7; 28/245, 246

[56] References Cited

U.S. PATENT DOCUMENTS 3,161,484 12/1964 Bagnoli et al. .
3,311,691 3/1967 Good .
3,409,957 11/1968 Carter ..... 264/290.5
3,564,835 2/1971 Keefe, Jr. et al. ..... 264/290.5

FOREIGN PATENT DOCUMENTS 13722 8/1967 Japan .
11966 5/1969 Japan .
410 1/1971 Japan .

*Primary Examiner*—James Lowe

[57] ABSTRACT

In a coupled two-stage draw, constant-length annealing process for making polyamide yarn, heat for assisting the second-stage draw is provided by means of an environmentally-heated metal shoe located in an annealing hot chest.

4 Claims, 1 Drawing Figure

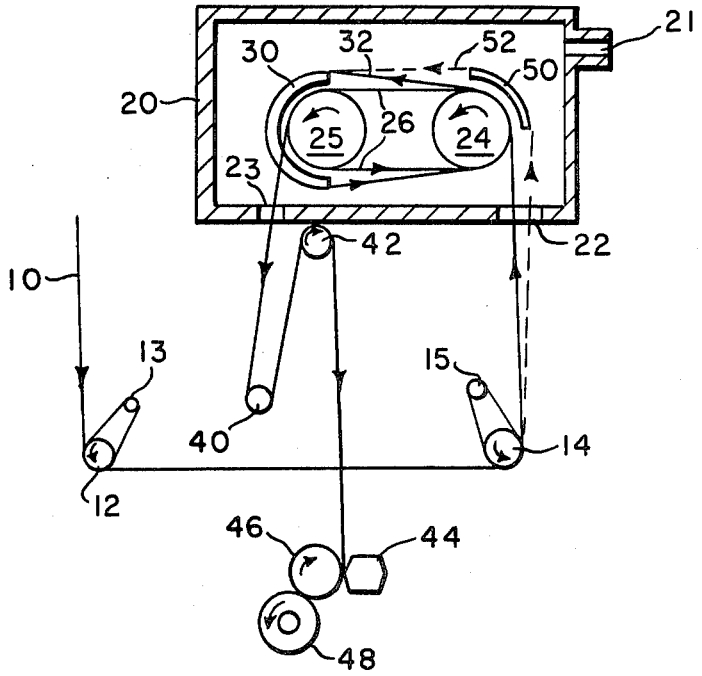
21
30
32
52
50
20
25
26
24
23
42
22
10
13
15
40
14
12
46
44
48

PROCESS FOR DRAWING POLYAMIDE YARN

DESCRIPTION

TECHNICAL FIELD

This invention relates to an improved coupled process for drawing a polyamide yarn in two stages followed by annealing the drawn yarn with heat at constant length prior to winding it into a package. More particularly, it relates to such a process wherein heat for assisting the second stage of drawing is obtained from the annealing environment.

BACKGROUND OF THE INVENTION

Freshly drawn polyamide filaments are commonly annealed with heat while being maintained at constant length to improve their dimensional stability as taught for example in U.S. Pat. No. 3,311,691. Such processes, generally subject the yarn to a controlled relaxation before cooling. These processes are most commonly employed in the manufacture of high tenacity yarns for industrial uses because of the high draw ratios employed to obtain high strength. Various means of assisting the drawing with heating devices are used to facilitate such processes. Assisting the drawing with heat reduces the drawing tension and improves operability of the process. Heat assisted two-stage drawing also is taught in U.S. Pat. No. 3,311,691.

This invention provides a simple means for supplying heat to assist the second stage of drawing in such known processes, eliminating the need for more expensive heat-draw assisting devices of the prior art.

DESCRIPTION OF THE DRAWING

The FIGURE is a schematic representation of a process of this invention and of an apparatus suitable for carrying it out. In the FIGURE, driven roll 12 and associated separator roll 13 define a first draw zone feeding means for yarn 10 coming from a conventional melt-spinning position (not shown). Driven roll 14 and associated separator roll 15 comprise the draw rolls for the first drawing stage as well as the feed roll for the second drawing stage. A pair of first and second driven rolls, 24 and 25 respectively, provide the tension for the second drawing stage and maintain the yarn within chest 20 at a constant length by means of multiple yarn wraps 26. Chest 20 is thermally insulated and heated by means of a circulating hot air environment supplied through duct 21. The chest also has a yarn entry 22 and yarn exit 23. Located within the chest and partially surrounding a rear portion of second roll 25 is a semicircular metal shoe 30 which provides a means for diverting yarn 10 in its first pass around roll 25 into yarn path 32 which prevents yarn 10 from contacting roll 25 and raises its temperature before it returns to the surface of roll 24. Shoe 30 is maintained at the same temperature of rolls 24 and 25 by means of the hot air environment supplied through duct 21. Also shown is an optional second curved metal shoe 50 which again diverts yarn 10 into an alternate path 52 on its first pass around first roll 24. Shoe 50 also is maintained at the same temperature of the hot air environment. After making multiple wraps 26 around rolls 24, 25, yarn 10 exits the chest under controlled tension provided by puller roll 40 followed by a let down roll 42 prior to being wound up by a conventional winding device comprised of traversing mechanism 44 and drive roll 46 where it is wound into a yarn package 48.

DESCRIPTION OF THE INVENTION

This invention provides an improved coupled process for drawing a polyamide yarn in first and second stages assisted by heat in at least the second stage followed by annealing the drawn yarn by heating at constant length prior to winding it into a package where the yarn is annealed by making multiple wraps around a pair of first and second heated rolls which are maintained at a constant temperature within an enclosure by means of a circulating hot-air environment wherein the improvement comprises heating the yarn within said enclosure to assist the second stage drawing by diverting the yarn from a path which contacts the surface of at least the second of said pair of rolls on its first pass around the rolls by means of a curved, environmentally-heated metal shoe which heats the yarn and reduces its drawing tension before the yarn becomes fully drawn and the yarn speed reaches that of the heated rolls. In a preferred embodiment the yarn on its first pass is permitted to contact the first roll for up to about 90° of its circumference in order to stabilize the yarn position and facilitate raising of its temperature. Contact with the shoe associated with the second draw roll is preferably throughout an angle of about 180° which eliminates contact with the second roll on the first pass and permits the yarn to return to the surface of the first roll for its second pass or wrap.

For many textile applications where only moderate strength yarns are required, suitable polyamide yarns can be made by so called "space-drawing" processes which do not require special draw-assist heating devices in order to obtain an adequate draw ratio. Equipment suitable for such processes however is not suitable for making high-strength yarns which require higher draw ratios necessitating the use of heating devices to facilitate drawing. This invention, among other things, provides a simple process and apparatus for inexpensively adapting a process suitable for making textile yarns to the production of high strength yarns where environmentally-heated annealing rolls are already available. With such a process or apparatus if an attempt is made to increase the second stage draw ratio to that required for high tenacity industrial yarns, the draw point will shift onto the surface of the heated annealing rolls resulting in erratic behavior and unacceptable performance. This problem is eliminated by the present invention by the use of environmentally heated shoes which function to hold the yarn off the surface of the draw rolls in their initial pass and heat the yarn to provide improved control of the drawing process.

In this manner the invention provides a means to reduce drawing forces and to localize the draw point at higher draw ratios than would otherwise be obtainable under the same conditions.

The draw assisting device of this invention is comprised of a curved metal shoe, for example having a conventional nodular chrome surface known for use with draw pin or tubular drawing devices. The shoe conveniently fits into the back of an annealing chest around at least the second of two hot annealing rolls in a position to be contacted by the yarn on its initial pass around the second roll in the chest while not interfering with subsequent wraps around both rolls and removal from the chest at the end of the treatment. The circular curvature of the shoe preferably is axially concentric with the roll with which it is associated. This will maintain the desired skew and cant angle between its surface and that of the other roll, as known in the art to effect advance of the yarn along the surface of the rolls with each wrap for the desired number of wraps, length of contact and stabilization.

In a typical process the stabilization rolls, acting as the draw rolls for the second stage of the drawing process, operate at a controlled surface speed approximately 35% faster than that of the previous roll contacted by the yarn. By this invention drawing forces between such rolls can be reduced approximately by $\frac{1}{3}$ to $\frac{1}{4}$ that required for cold drawing of a typical 210 denier 66-nylon yarn.

Heated chests and rolls suitable for modification and use in this invention are known in the art, particularly as described in U.S. Pat. No. 3,161,484 (Bagnoli et al).

Polyamides suitable for use in yarns processed by this invention include the synthetic linear aliphatic polycarbonamides such as commonly referred to as nylon, including 66-nylon and 6-nylon.

EXAMPLE

Freshly spun yarns of poly(hexamethylene adipamide) having a relative viscosity of about 50 (measured as described in U.S. Pat. No. 2,385,890) are drawn and annealed according to the process of the FIGURE, but without optional shoe 50.

Shoe 30 is mounted around the second driven roll of a pair enclosed in a heated chest of the type described in U.S. Pat. No. 3,161,484 by welding it to a ring made from an $8\frac{3}{4}$ inch outside diameter seamless steel tubing having a 0.50 inch wall thickness and being 0.25 inches thick. The ring is provided with 3 substantially equal spaced brackets for bolting to the rear of the chest. A nodular chrome-plated shoe having substantially the same diameter as the ring is welded to the ring. The shoe is 3.25 inches wide, 0.13 inches thick and has a surface radius of curvature of 4.17 inches. To provide a contact area throughout a semi-circular path of at least 180°, the shoe spans an angle of somewhat more, about 212°. The yarn contacting surface of the shoe is provided with a conventional nodular chrome-plated surface as known in the art. Roll 25 about which shoe 30 is mounted has a surface diameter of 8 inches and is 12 inches long. The shoe has a slightly raised rim along both its inner and outer edges to keep the yarn from slipping off the shoe. The shoe and roll 25 are mounted axially concentric with one another. To provide a helical yarn path for multiple wraps around roll 24, 25, as known in the art, roll 25 is mounted with a 1.5° cant and roll 24 with a 7.5° skew. By means of a steam heat exchanger, circulating air in the chest is maintained at about 185° C.

As shown in the FIGURE, the yarn enters the chest vertically upward, contacts the first roll throughout an angle of approximately 90° passes around shoe 30 for approximately a 180° wrap and returns to the surface of first roll 24. It then makes about $5\frac{3}{4}$ passes around both rolls before exiting the chest.

The use of the shoe provides a yarn path in the chest of about 40 inches for heating both by hot air and by surface contact in which the yarn is heated and drawn before sustained contact with the rolls at constant length is established.

The freshly spun yarn contains a conventional emulsion finish having a finish oil concentration of about 13.5% by weight in water. Aside from water, the primary ingredient of the emulsion finish is coconut oil.

Under these conditions a yarn having a drawn denier of about 210 and containing 68 filaments is prepared using a first stage (space) draw ratio at ambient temperature of about 3.25X and about 1.3X in the second stage. The rolls in the chest are operated at a surface speed of 3370 ypm and the yarn is wound up at a speed of 3200 ypm.

The yarn has a tenacity of 7.5 gpd, an elongation-at-break of 23%, an initial modulus of 41 gpd and a boil-off shrinkage of 6.7%. The yarn has a sufficiently high strength and modulus to be suitable for use in woven industrial fabrics.

A yarn of 420 denier and 136 filaments having substantially comparable physical properties is prepared in substantially the same manner by double ending of two freshly spun yarns of 68 filaments each.

By using an oil based finish in place of the water based emulsion finish, to eliminate the plasticization effect of water on yarn, yarns of even higher tenacity are obtained under otherwise comparable conditions but with some sacrifice in process continuity, possibly associated with uniformity of application towards which no attempt is made to correct as part of the experiment.

In a similar manner using an oil based finish, a total draw ratio of 4.4X and a chest temperature of 180° C., yarn having a tenacity of 8.1 gpd and of sufficient strength to have potential as a sewing thread is obtained.

Attempts to obtain yarns of comparable properties as above on the same equipment without the metal shoe by employing higher chest temperatures and higher draw ratios are unsuccessful for reasons including inadequate strength and/or satisfactory operability.

Higher tenacity levels can be achieved by increasing the polymer RV.

What is claimed is:

1. An improved coupled process for drawing a polyamide yarn in first and second stages assisted by heat in at least the second stage followed by annealing the drawn yarn by heating at constant length prior to winding it into a package where the yarn is annealed by making multiple wraps around a pair of first and second heated rolls which are maintained at a constant temperature within an enclosure by means of a circulating hot-air environment wherein the improvement comprises heating the yarn within the enclosure to assist the second stage drawing by diverting the yarn from a path which contacts the surface of at least the second of said pair of rolls on its first pass around the rolls by means of a curved, environmentally-heated metal shoe which heats the yarn and reduces its drawing tension before drawing is completed and the yarn speed reaches the surface speed of the rolls.

2. Process of claim 1 wherein the yarn makes slipping contact with the first of said pair of heated rolls before being diverted from said second roll by said shoe on its first pass around both rolls.

3. Process of claim 1 or 2 wherein the polyamide is poly(hexamethylene adipamide).

4. Process of claim 1 wherein a second environmentally-heated metal shoe heats the yarn and diverts it from contact with the first roll on its first pass around both rolls and said other shoe.

* * * * *